US005826444A

United States Patent [19]

Capron et al.

[11] Patent Number: 5,826,444

[45] Date of Patent: Oct. 27, 1998

[54] PROCESS AND DEVICE FOR LIQUEFYING A GASEOUS MIXTURE SUCH AS A NATURAL GAS IN TWO STEPS

[75] Inventors: Pierre Capron; Alexandre Rojey, both of Rueil Malmaison, France

[73] Assignee: Institut Francais du Petrole, Rueil-Malmaison, France

[21] Appl. No.: 777,063

[22] Filed: Dec. 30, 1996

[30] Foreign Application Priority Data

Dec. 28, 1995 [FR] France ..... 95 15623

[51] Int. Cl.[6] ..... F25J 3/00

[52] U.S. Cl. ..... 62/612; 62/912

[58] Field of Search ..... 62/612, 912

[56] References Cited

U.S. PATENT DOCUMENTS

| | | | |
|---|---|---|---|
| 3,780,535 | 12/1973 | Darredeau | 62/612 |
| 3,970,441 | 7/1976 | Etzbach et al. | 62/612 |
| 4,112,700 | 9/1978 | Forg | 62/612 |
| 4,251,247 | 2/1981 | Gauberthier et al. | 62/612 |
| 4,539,028 | 9/1985 | Paradowski et al. | 62/612 |

FOREIGN PATENT DOCUMENTS

| | | | |
|---|---|---|---|
| 0 131 947 | 1/1985 | European Pat. Off. . | |
| 1 538 208 | 7/1968 | France . | |
| 2242998 | 3/1974 | Germany | 62/612 |
| 1181049 | 2/1970 | United Kingdom | 62/612 |
| 1314174 | 4/1973 | United Kingdom | 62/612 |
| 1472196 | 5/1977 | United Kingdom | 62/612 |
| 95 18345 | 7/1995 | WIPO . | |

*Primary Examiner*—Christopher Kilner
*Attorney, Agent, or Firm*—Antonelli, Terry, Stout & Kraus, LLP

[57] ABSTRACT

The process allows to liquefy a gaseous mixture consisting at least partly of a mixture of hydrocarbons, such as a natural gas, by using a cooling mixture that is obtained, after a first cooling step, in a state referred to as "condensed single-phase" state.

21 Claims, 6 Drawing Sheets

PROCESS AND DEVICE FOR LIQUEFYING A GASEOUS MIXTURE SUCH AS A NATURAL GAS IN TWO STEPS

FIELD OF THE INVENTION

The present invention relates to a process and to a device allowing to liquefy a fluid or a gaseous mixture consisting at least partly of a mixture of hydrocarbons, for example a natural gas.

BACKGROUND OF THE INVENTION

Natural gas is commonly produced in sites remote from the places where it is intended to be used and it is commonly liquefied in order to be transported over long distances by LNG carriers or stored in the liquid form.

The processes used and described in the prior art, notably in U.S. Pat. Nos. 3,735,600 and 3,433,026, describe liquefaction processes mainly comprising a first step during which the natural gas is precooled by vaporization of a cooling mixture, and a second step allowing to carry out the final operation of liquefaction of the natural gas and to obtain the liquefied gas in a form that can be transported or stored, cooling during this second step can also be provided by vaporization of a cooling mixture.

In such processes, a mixture of fluids used as a cooling fluid in the external cooling cycle is vaporized, compressed, cooled by heat exchange with an ambient medium such as water or air, condensed, expanded and recycled.

The cooling mixture used in the second stage where the second cooling step is carried out is cooled by heat exchange with the ambient cooling medium, water or air, then in the first stage where the first cooling step is carried out.

After leaving the first stage, the cooling mixture exhibits the form of a two-phase fluid comprising a vapor phase and a liquid phase. Said phases are separated, for example in a separating drum, and fed for example into a spiral-tube exchanger in which the vapor fraction is condensed, while the natural gas is liquefied under pressure, cooling being effected by vaporization of the liquid fraction of cooling mixture. The liquid fraction obtained by condensation of the vapor fraction is supercooled, expanded and vaporized in order to effect the final liquefaction of the natural gas that is supercooled prior to being expanded through a valve or an expander in order to produce the wanted Liquefied Natural Gas (LNG).

The presence of a vapor phase calls for a condensation operation on the cooling mixture at the level of the second stage, which requires a relatively complex and expensive device.

The prior art also describes processes working by compression and expansion of a permanent gas such as nitrogen, which has the advantage of exhibiting a simple design. However, the performance of such device types is limited and they are furthermore ill-suited to industrial natural gas liquefaction plants of great capacity.

SUMMARY OF THE INVENTION

What is referred to as natural gas in the description hereafter is a mixture mainly consisting of methane, but which can also contain other hydrocarbons and nitrogen, whatever the state in which it is (gaseous, liquid or two-phase). Natural gas initially mainly occurs in the gaseous state and at such a pressure value that, during the liquefaction step, it can occur in different states, for example liquid and gaseous, coexisting at a given time.

The object of the present invention is to provide a simpler and less expensive process and/or a device for liquefying a fluid, notably a natural gas, by carrying out a more extensive cooling step at the level of the first stage of the liquefaction plant, while operating under such conditions that, when leaving the first stage, the cooling mixture used notably as a cooling agent in the second stage is in the single-phase form in the condensed phase, comprising practically no vapor phase or in minor proportions.

In the description hereafter, the expressions "single-phase in the condensed phase" or "condensed single-phase" refer to a state that characterizes a cooling mixture or a fluid in the liquid form or corresponding to a supercritical phase, in contrast with the two-phase state that characterizes the prior art.

The present invention relates to a process for liquefying a fluid G consisting at least partly of a mixture of hydrocarbons, for example a natural gas.

The liquefaction process is characterized in that it comprises at least the following steps:

a) said fluid G is cooled under pressure and a cooling mixture M is cooled under pressure and temperature conditions selected to obtain, at the end of step a), a condensed single-phase cooling mixture, the temperature at the end of step a) being below −40° C., b) said cooling mixture from the first step a) is supercooled, expanded and vaporized so as to effect the supercooling of at least said fluid G and the supercooling of the cooling mixture, and c) said fluid supercooled during step b) is expanded in order to obtain it in the liquid phase at low pressure.

According to a method of implementation of the process, the cooling mixture M vaporized during step b) can be compressed and recycled to step a).

At the end of step a), the condensed single-phase cooling mixture is for example in the liquid phase or the cooling mixture may be in the dense phase, and the temperature is below −60° C.

The dense phase is for example a supercritical dense phase.

According to a method of implementation of the process, during step a), the cooling mixture is for example cooled at a pressure at least equal to 3 MPa.

The cooling mixture M used during the second step b) can comprise at least one or more of the following constituents: methane, ethane, propane, nitrogen.

According to a mode of implementation of the method, the cooling mixture M from step a) is expanded for example to at least two different pressure levels.

Independent cooling cycles can be used for the first step a) and the second step b).

According to an embodiment, a single cooling cycle is used for the first and the second step, the cycle operating for example with a cooling mixture partly condensed by heat exchange with cooling water and/or air, the liquid fraction resulting from this partial condensation being for example supercooled, expanded and vaporized to effect at least partly the cooling required during this first step, and the vapor fraction resulting from this partial condensation forming at least partly the mixture M which is in the condensed single-phase at the end of the first step a).

The fluid G consisting at least partly of a mixture of hydrocarbons is for example circulated in an ascending flow and fluid G is fractionated during step a) by matter exchange between the fluid and at least one condensed liquid fraction circulating in a descending flow.

At least one of the cooling steps of step a) and/or of step b) is for example carried out in a brazed aluminium plate exchanger or in a stainless steel plate exchanger.

The present invention also relates to a device for liquefying a fluid G consisting at least partly of a mixture of hydrocarbons, such as a natural gas.

It is characterized in that it comprises for example:

at least a first cooling zone suited to operate under temperature conditions up to at least −40° C., so as to obtain at the outlet thereof a condensed single-phase cooling mixture, and to cool said fluid G to at least −40° C., this first cooling zone communicating with at least at least a second cooling zone suited to operate for example up to a temperature at least below −160° C., after which fluid G is cooled to at least −160° C., and at least one means for expanding the cooled fluid G from the second cooling zone, this expansion means being for example placed after the second cooling zone.

The second cooling zone is for example suited to effect the supercooling of the condensed single-phase cooling mixture.

The device is for example suited to liquefy and to fractionate a fluid G such as a natural gas and it can comprise at least one means for fractionating fluid G so as to obtain a gas phase enriched in light hydrocarbons and a liquid phase enriched in heavy hydrocarbons.

The fractionation means comprises or comprise for example a heat exchanger equipped with means for drawing off the various constituents of the fractionated natural gas.

The device comprises, at the level of the first cooling zone and/or at the level of the second cooling zone, one or more heat exchangers.

At least one of the cooling zones comprises for example one or more heat exchangers, for example a plate exchanger or a brazed aluminium plate exchanger, or a stainless steel plate exchanger.

The present invention thus notably affords the advantages as follows:

the cooling mixture being, at the end of the fit step, in the state referred to as "condensed single-phase" state, an operation of liquefaction of the gas or vapor phase requiring complex and expensive devices, for example spiral-tube exchangers, is avoided at the level of the second stage of the process, it is no longer necessary to separate, at the outlet of the first cooling stage, the mixture used in the second stage into a liquid fraction and a vapor fraction, cooling of the mixture used in the second stage close to critical conditions saves from having to carry off, at low temperature, a high condensation enthalpy, which allows to improve the operating conditions of the second stage and to make it less expensive.

BRIEF DESCRIPTION OF THE DRAWINGS

Other features and advantages of the invention will be clear from reading the description hereafter given by way of embodiment examples, within the scope of non limitative applications to the liquefaction of natural gas, with reference to the accompanying drawings in which.

DESCRIPTION OF THE INVENTION

Figure 1:
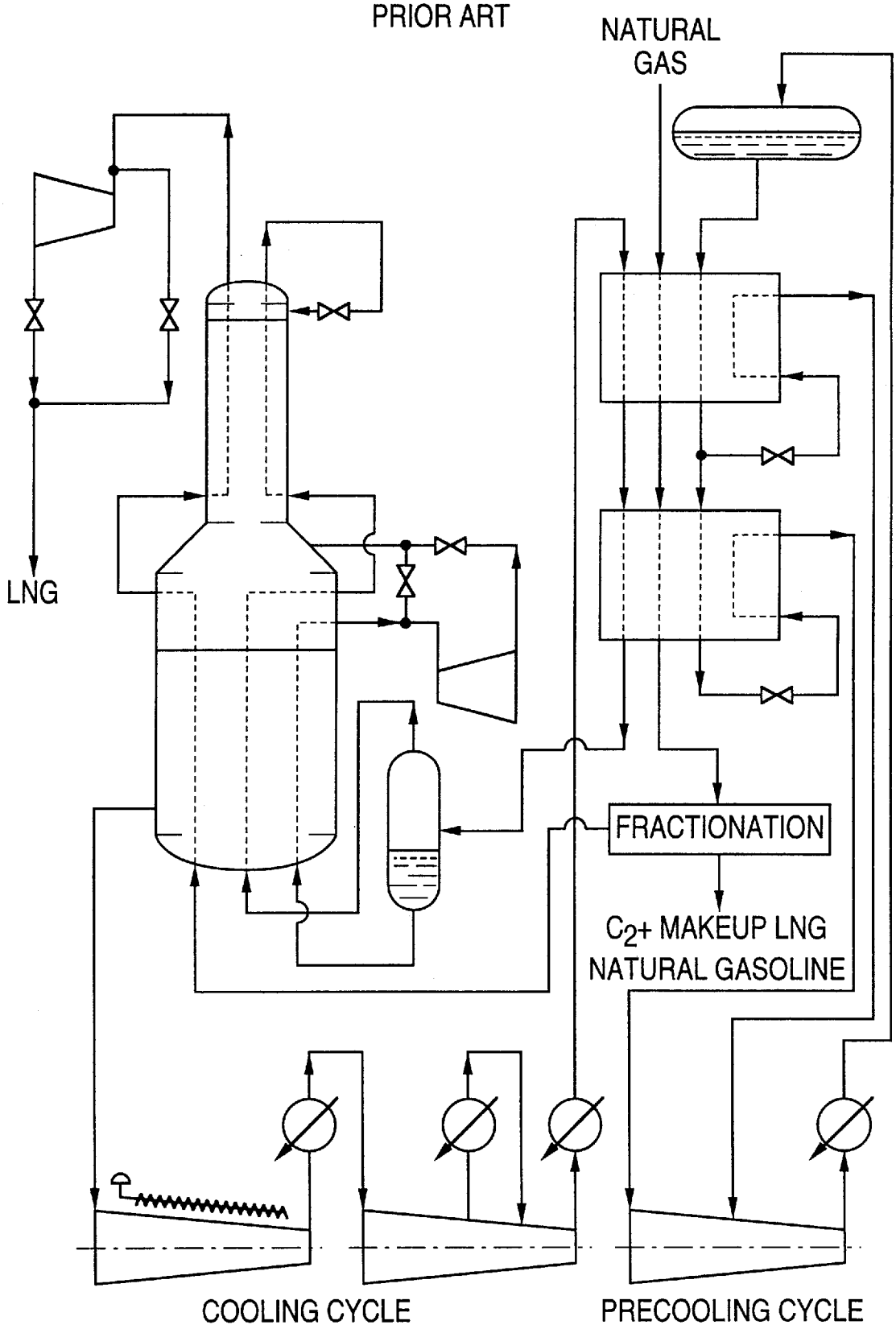
FIG. 1 PRIOR ART
FIG. 1 diagrammatically shows an example of a liquefaction cycle as described and used in the prior art, FIGS. 2, 3 and 4 diagrammatically show respectively the steps of the natural gas liquefaction process and the pressure-enthalpy diagrams describing the evolution of the state of a cooling mixture.

FIG. 1 shows a flowsheet of a process used according to the prior art applied to the liquefaction of natural gas.

The process comprises a first natural gas cooling stage after which the temperature of the natural gas and that of the cooling mixture used are substantially −30° C.

After leaving the first cooling stage, the cooling mixture used in the second cooling stage exhibits the form of a two-phase fluid comprising a vapor phase and a liquid phase, said phases being separated by means of a device represented in the figure by a separating drum. These two phases are fed into a spiral-tube exchanger allowing to achieve the final cooling of the natural gas precooled during the first step. To that effect, the vapor phase from the separating drum is condensed by using the liquid fraction as a cooling fluid, then supercooled and vaporized in order to effect the cooling and the liquefaction of the natural gas.

The principle implemented according to the invention described hereafter is mainly based on at least two steps. At the end of the first step, the cooling mixture used during the second cooling step is in the "condensed single-phase" state, i.e. mainly in the form of a single phase, for example a liquid phase or a supercritical dense phase, and during the second step to be carried out, the final liquefaction of the natural gas cooled during the first step by means of this cooling mixture, in the is condensed single-phase state.

In relation to the process according to the prior art, the cooling mixture used during the second cooling step comprises no vapor phase, or in minor proportions at the end of the first liquefaction step. An operation of condensation of the vapor fraction is thus avoided.

The cooling mixture is preferably under conditions close to critical conditions (close to the critical point of the mixture), either in the liquid phase state or in the supercritical dense phase state.

Figure 2:
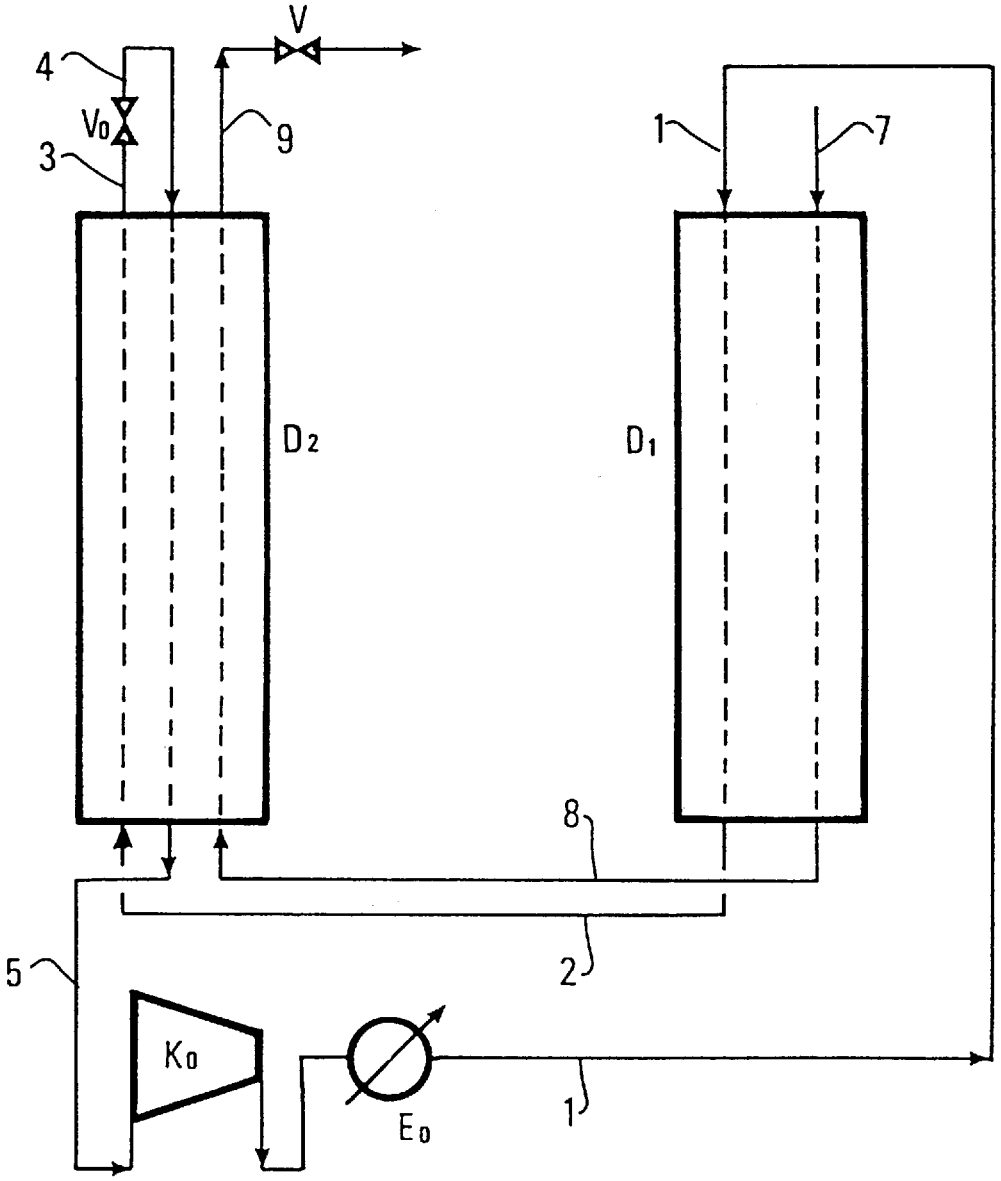
Figure 3:
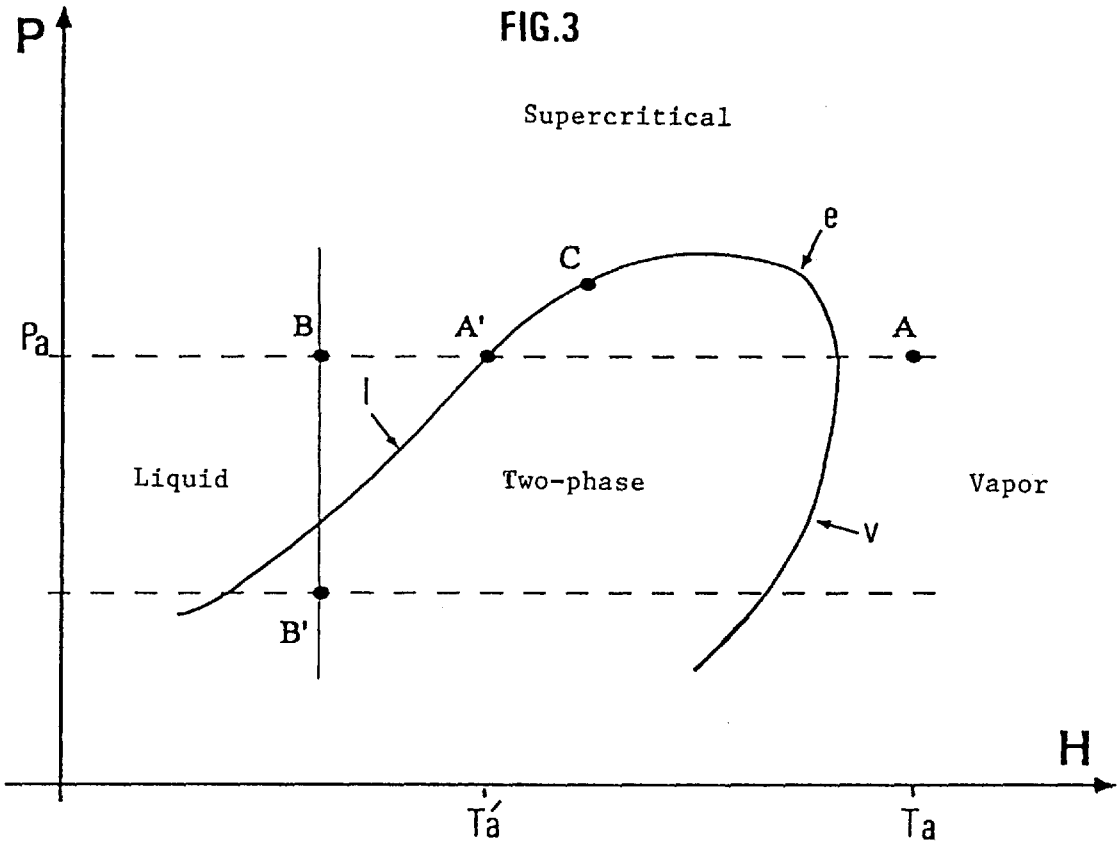
Figure 4:
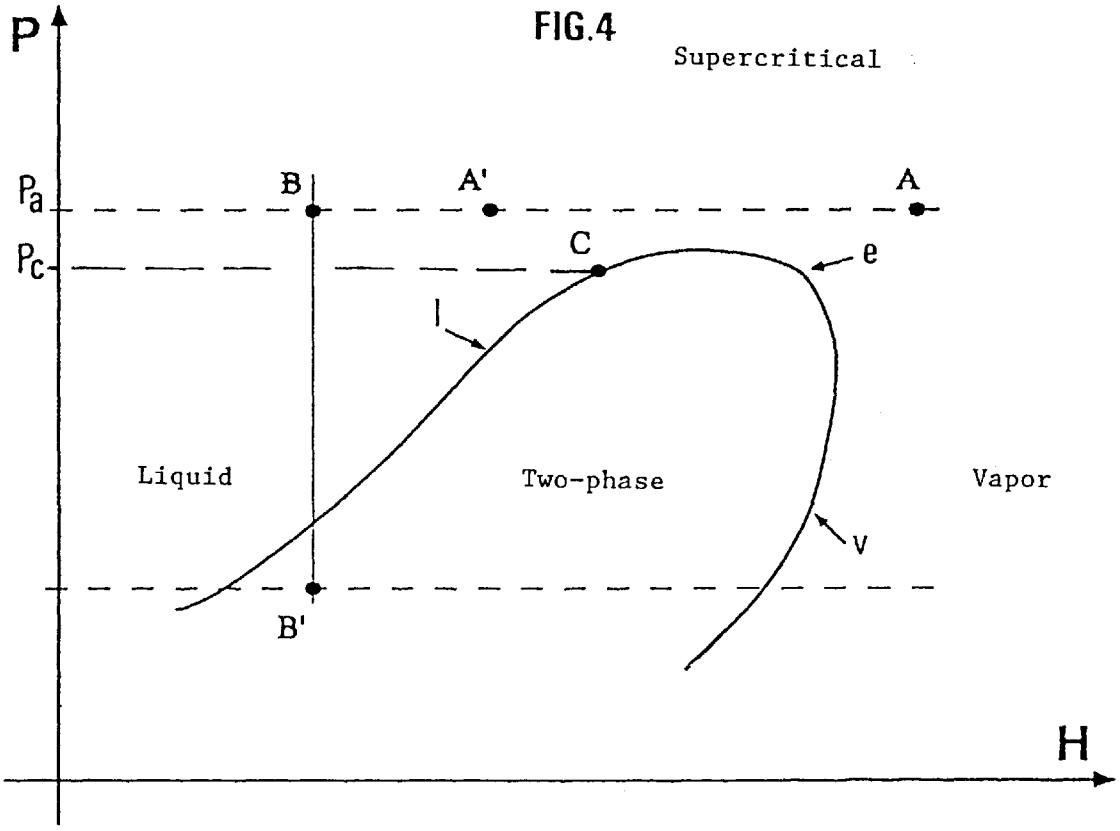

Thus, the process according to the invention described hereafter in connection with FIGS. 2, 3 and 4 consists in carrying out the first step by selecting such thermodynamic conditions, for example the pressure and the temperature, that at the end of this first step the cooling mixture is in the state referred to as "condensed single-phase" state.

FIG. 2 shows a flowsheet of the process according to the invention where only the paths followed by the cooling mixture used as the cooling agent at the level of the second stage and by the natural gas to be liquefied are shown.

The liquefaction process comprises two cooling stages represented by references $D_1$ and $D_2$. The cooling mixture is fed into the first stage $D_1$, in the gas phase, through a line 1 at a temperature close to the ambient temperature, for example about 40° C., and at a pressure for example close to 6 MPa. It is then cooled in this stage $D_1$ and leaves it at a temperature preferably at least below −40° C., for example close to −70° C. At the outlet of the first stage $D_1$, it is in the "condensed single-phase" state, notably but not exclusively in the form of a liquid phase or of a supercritical dense phase obtained by following an evolution in a pressure-enthalpy co-ordinates diagram that is either similar to the evolution shown by the diagram of FIG. 3 (liquid condensed phase at the end of the first cooling step), or similar to that shown by the diagram of FIG. 4 (supercritical dense phase at the end of the first cooling step).

The cooling mixture in the "condensed single-phase" state is thereafter fed through line 2 into a second stage $D_2$ where it is used as a coolant for the natural gas, for example by heat exchange. After supercooling, the cooling mixture is expanded through an expansion device such as a valve $V_0$ situated on line 3, or an expander that has the advantage of improving the performances of the cooling cycle. The expanded cooling mixture is then fed through line 4 into the second stage $D_2$ and vaporized at least partly in order to effect the final cooling of the natural gas. At the outlet of the second stage, the mixture is fed through line 5 into a compression device comprising for example a compressor $K_0$ and an exchanger $E_0$ situated for example after the compressor, prior to being fed back to the first stage $D_1$ through line 1.

The natural gas to be liquefied is fed, at a temperature of the order of 40° C. for example and at a pressure for example close to 6 MPa, through line 7, into the first stage $D_1$ where it is precooled by the cooling mixture. At the outlet of this first stage, it is at a temperature preferably at least below −40° C. and at a pressure substantially equal to the initial pressure value thereof.

It is then passed into the second stage through line 8 where it is cooled to the wanted final temperature, for example a temperature close to −160° C., prior to being expanded by a suitable device such as a valve V or an expander, situated for example on line 9 and forming a continuation of the second stage $D_2$.

The evolution followed by the cooling mixture used in the second stage is schematized in a pressure (P)-enthalpy (H) co-ordinates diagram shown in FIGS. 3 and 4, respectively for a cooling mixture that is in the liquid form or in the supercritical dense form after leaving the first stage.

In these diagrams, the curve bearing reference "e" represents the phase envelope delimiting the range within which the cooling mixture can form two phases, respectively liquid and vapor, at equilibrium.

FIG. 3 schematizes the evolution of the thermodynamic state of the cooling mixture when the mixture is in the liquid condensed single-phase state at the end of the first step (at the outlet of $D_1$). It is initially in the gas or vapor phase represented in the diagram by point A corresponding to a temperature Ta and to a pressure Pa. In the first stage $D_1$, the mixture is cooled to a temperature Ta' preferably below −40° C. until it reaches a liquid state represented for example by point A' on the liquid branch (1).

The cooling mixture mainly in the liquid phase is supercooled in the second stage $D_2$, this evolution being shown in the diagram by the passage from point A' to point B, then expanded, thus passing from point B to point B'.

When expansion is achieved by means of a valve, it is substantially isenthalpic. This expansion through a valve is represented in the diagram of FIG. 3 by the passage from point B to point B'.

Without departing from the scope of the invention, it can also be achieved by means of an expander, then following an evolution close to an isentropic evolution.

In another implementation example of the process according to the invention, the cooling mixture is initially in the supercritical state represented in the diagram of FIG. 4 by a point A corresponding to a pressure Pa above the cricondenbar pressure Pc.

The cooling mixture is cooled in the first stage according to a substantially isobaric evolution schematized in the diagram by the passage from point A to point A', without passing through the two-phase domain.

At point A', the mixture is in the dense supercritical phase state from which a liquid phase is obtained by expansion while constantly avoiding going through a discontinuous phase change.

The cooling mixture is then supercooled in the second stage by following an evolution represented in the diagram by the passage from point A' to point B.

It is thereafter expanded, for example by means of a valve, by following the evolution described by the passage from point B to point B', and expansion can also be achieved by means of an expander.

After expansion, the cooling mixture is vaporized in order to effect the final cooling of the natural gas.

Stages $D_1$ and $D_2$ comprise suitable devices allowing to cool the cooling mixture and to perform the cooling and the final expansion of the natural gas so as to obtain a liquefied natural gas that can be transported or in a state allowing to store it.

The first stage $D_1$ comprises for example one or more heat exchange zones using multipass exchangers such as, for example, plate exchangers in order to lower the temperature of the cooling mixture and to reach at least a temperature preferably below −40° C. so as to obtain, at the outlet of $D_1$, a cooling mixture in the liquid condensed or supercritical phase for example.

The second stage $D_2$ similarly comprises for example one or more heat exchangers and devices allowing to expand and to vaporize the cooling mixture in order to use it as a cooling agent and to perform the final natural gas cooling operation. At the outlet of this second stage, the natural gas cooled during the first two steps is expanded through a suitable device in order to obtain the Liquefied Natural Gas (LNG).

The base principle of the process consists, during a first cooling step, in cooling simultaneously the natural gas and a cooling mixture initially in the vapor phase, at a pressure sufficiently high and at a temperature sufficiently low to obtain, at the end of the first cooling step, a "condensed single-phase" cooling mixture as defined above, that is thereafter fed to a second cooling step where it is supercooled, then expanded and vaporized in order to effect the cooling required in this second step.

The pressure at which the cooling mixture is cooled in the first step is preferably at least 3 MPa.

The temperature to which the cooling mixture is cooled in the first step is preferably at least below −40° C., and preferably less than −60° C.

Because of the specific thermodynamic conditions required to carry out the process, some cooling mixtures are particularly well-suited for this operation.

The process according to the invention thus preferably uses a mixture of cooling M to carry out the step b) comprising for example at least one or more constituents selected from the following list: methane, ethane, propane and/or nitrogen.

The constituent or constituents selected are for example present in the cooling mixture in the proportions as follows, expressed in moles per cent:

$C_1$ between 65 and 95%

$N_2$ between 0 and 20%

$C_2$ between 0 and 30%

$C_3$ between 0 and 20%.

Figure 5:
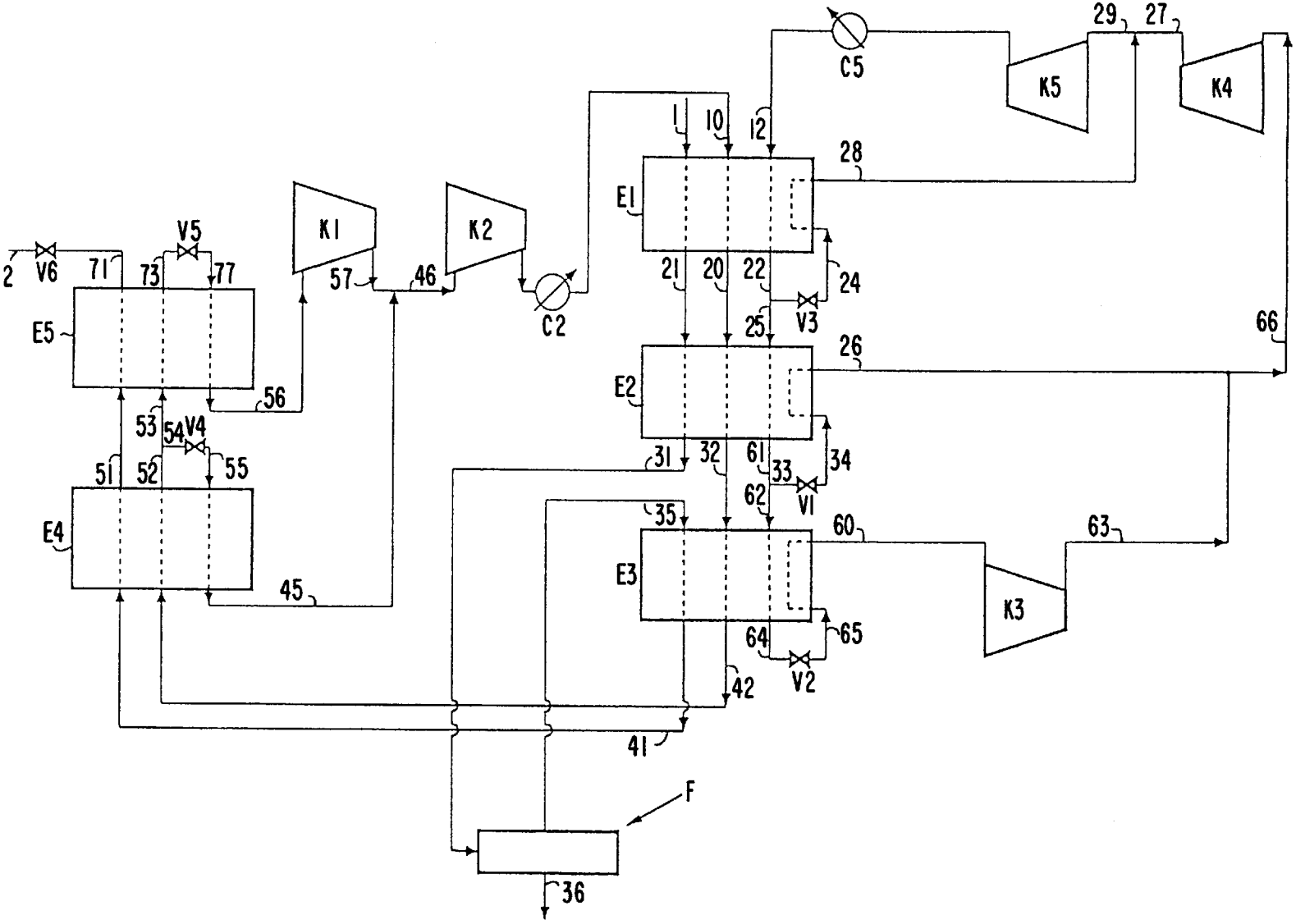
FIG. 5 shows an embodiment variant of the invention applied to the liquefaction of natural gas, comprising independent cooling cycles for the two cooling stages, FIG. 6 diagrammatically shows another embodiment variant in which cooling of the first and of the second stage is performed by means of a single cycle, and FIG. 7 diagrammatically shows a variant of the device allowing the liquefaction and the fractionation of the natural gas to be carried out simultaneously.

FIG. 5 illustrates the application of the process according to the invention to the liquefaction of natural gas, comprising a first step at the end of which the cooling mixture is in the liquid form at a temperature for example close to −70° C., the liquid cooling mixture being then fed into the second stage. Since the cooling mixture fed into the second stage is in the condensed single-phase form, it is not necessary to perform, at the level of this second stage, a condensation operation of the vapor fraction of the cooling mixture that is usually carried out in the devices of the prior art.

In this embodiment example, the cooling required at the level of the first stage and of the second stage is performed by means of independent cooling cycles.

By way of non limitative example, the first stage ($D_1$ FIG. 2) comprises for example three heat exchange zones $E_1$, $E_2$, $E_3$ arranged in a cascade pattern, and the second stage ($D_2$ FIG. 2) comprises for example two heat exchange zones $E_4$ and $E_5$ arranged in a cascade pattern. Each of these stages is provided with expansion means such as expansion valves $V_1$ to $V_5$.

The heat exchange zones consist for example of individual exchangers distinct from one another and connected to each other, or of a single exchanger provided with the required draw-off and re-injection means.

Figure 7:
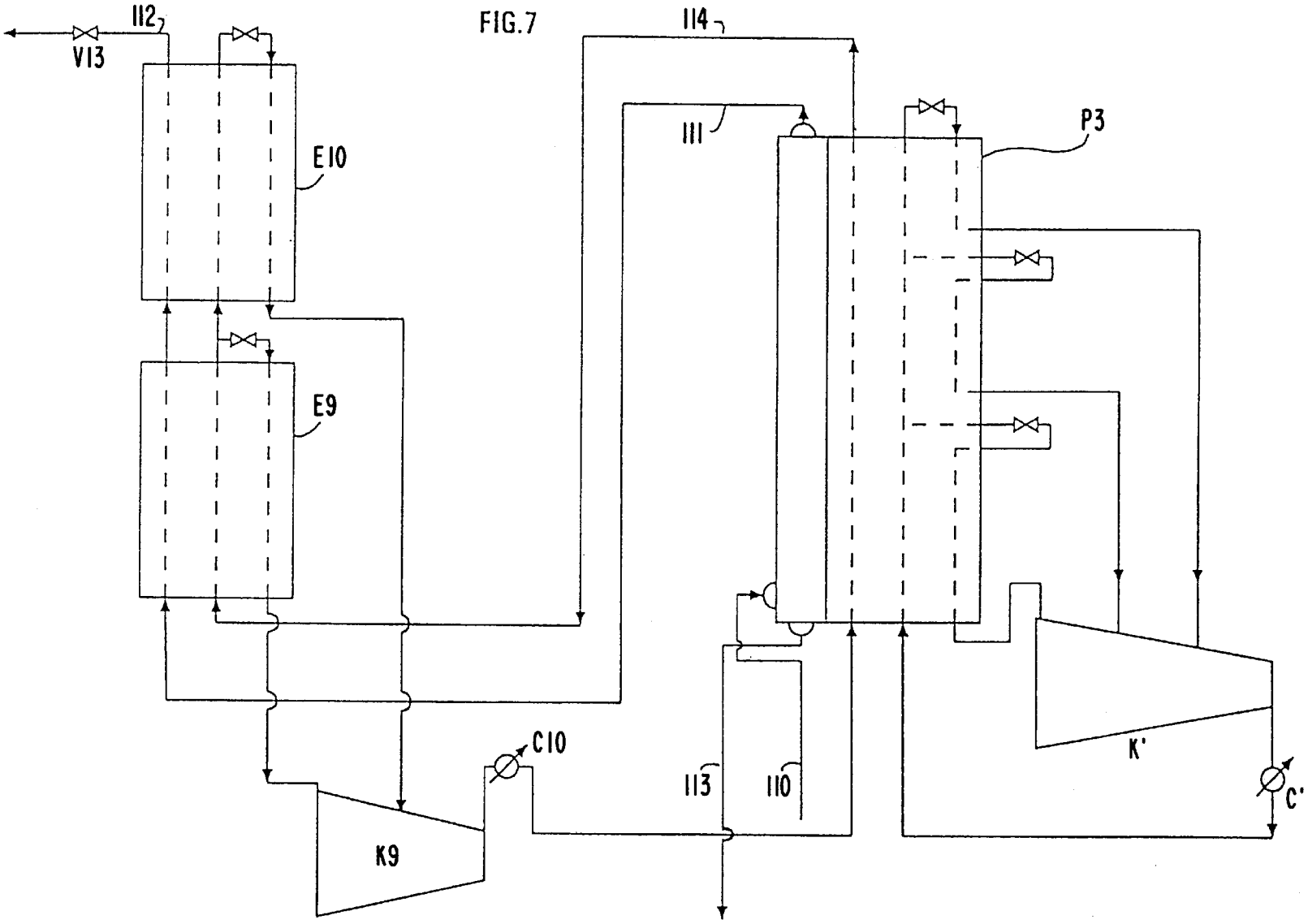

These stages can be obtained by means of various technologies, for example plate exchangers provided with draw-off and re-injection means allowing notably to transfer the natural gas to fractionating units shown notably in FIG. 7, which applies to all the instances mentioned in the description.

Furthermore, the outlet of the second stage, an expansion valve $V_6$ or an expander performs the final expansion of the cooled natural gas in order to obtain liquefied natural gas or LNG.

The cooling mixture used in the second stage, after vaporization, is compressed by means of compression stages $K_1$, $K_2$, then cooled in exchanger $C_2$ by means of cooling water or air for example prior to being fed back to the first stage.

The cooling cycles being independent, cooling at the level of the first stage is performed for example by means of a cooling cycle described in detail hereafter and comprising for example several compressors $K_3$, $K_4$, $K_5$ and a condenser $C_5$ allowing to compress and to condense the cooling mixture used in the first stage.

The cooling mixture used in the first stage comprises for example the constituents as follows: ethane, propane, butane, methane.

These constituents are used for example in the following proportions, expressed in moles per cent:

$C_2$ between 5 and 60%

$C_3$ between 5 and 60%

$C_4$ between 0 and 20%

$C_5$ between 0 and 10%.

Preferably, mixture of refrigerant used in the first cooling stage contains ethane. This mixture is preferably mainly composed of ethane, this latter being the constituent the proportion of which expressed in mole is the highest in the mixture.

The process implemented comprises for example the steps as follows:

The cooling mixture M used in the second cooling stage is fed into the first exchange zone $E_1$ through line 10, for example at a temperature close to 40° C. and at a pressure for example substantially equal to 6 MPa. It is cooled by means of a first fraction f1 of the cooling mixture M' (used in the first cooling step) and fed into the second exchange zone $E_2$ through line 20. Similarly, it is cooled by means of a second fraction f2 of the cooling mixture M' and fed into the third exchange zone $E_3$ where it is cooled by a third fraction f3 of the cooling mixture M', for example to a temperature of the order of −70° C. Its pressure is substantially close to its initial pressure value, i.e., in this implementation example of the process, slightly below 6 MPa because of the pressure drops in the heat exchange zones ($E_1$, $E_2$, $E_3$).

The way the three fractions f1, f2 and f3 of the cooling mixture M' allowing to cool and to change cooling mixture M to a "condensed single-phase" form are obtained is described hereafter.

Under the pressure and temperature conditions obtained at the outlet of the first stage, i.e. −70° C. and 6 MPa in the example mentioned, the cooling mixture M coming from the first stage mainly has a condensed single-phase form as defined above.

This cooling mixture M, mainly condensed, is led into the second stage where it is used as a cooling agent for the natural gas to be liquefied.

The natural gas to be liquefied is fed into the first heat exchange zone $E_1$ through line 1 at a temperature for example close to 40° C. and with a pressure for example equal to 6 MPa. It is cooled by passing successively through heat exchange zones $E_1$, $E_2$ and $E_3$, and by following a temperature and pressure evolution substantially close to that followed by the cooling mixture M. At the outlet of the third heat exchange zone $E_3$, it is for example at a temperature of the order of −70° C. and at a pressure close to its initial value, i.e. of the order of 6 MPa.

The natural gas thus cooled is fed, partly or totally, through line 41 into the second final cooling stage where it is cooled to the wanted final temperature by means of the cooling mixture M, according to the pattern described hereafter for example.

The cooling mixture M is fed, in the condensed phase, through line 42 into the first exchange zone $E_4$ of the second stage which it leaves through line 52. A fraction of this condensed single-phase cooling mixture is diverted through line 54 in order to be expanded by passing through valve $V_4$, then fed again through line 55 into heat exchange zone $E_4$, where it effects, by vaporizing at a first pressure level, the cooling of the natural gas flowing in through line 41 to a temperature for example close to −100° C., the natural gas being thereafter fed into the second heat exchange zone $E_5$ of the second stage.

The non-diverted fraction of the condensed single-phase cooling mixture M is fed into the second heat exchange zone $E_5$ of the second stage through line 53 and it flows out through line 73 in order to be expanded through valve $V_5$ prior to being fed into the second heat exchange zone $E_5$ to effect the final cooling of the natural gas to, for example, a temperature close to −160° C. prior to expanding it through an expansion valve $V_6$ situated on discharge line 71 to form the liquefied natural gas or LNG produced. The liquefied natural gas thus obtained is then fed through a line 72 for example to a transmission and distribution network.

Of course, without departing from the scope of the invention, the expansion valve can be replaced by an expander or by any device fulfilling a similar function, having notably the advantage of optimizing the efficiency of the process.

In this example, the cooling mixture M is expanded to two successive pressure levels. This allows the required compression power to be reduced by compressing the vaporized cooling mixture fraction leaving heat exchange zone $E_4$ from an intermediate pressure level and not from the lowest pressure required in heat exchange zone $\mathbf{5}_5$ to reach the final cooling temperature.

Without departing from the scope of the invention, cooling mixture M can also be expanded to several intermediate pressure levels in order to optimize the cooling cycle performances.

It is advantageously possible, for example at the level of the first cooling stage, to carry out a natural gas fractionating operation, for example on the natural gas leaving the second heat exchange zone $E_2$.

The temperature at which the natural gas fractionating operation is performed is selected notably according to its composition and to the specifications required for the LNG produced.

The natural gas is fed through line 31 into a fractionating device F that allows to fractionate the natural gas and to obtain at least a liquid fraction containing part of the heaviest hydrocarbons mixed with methane and at least a second methane-enriched fraction. This second fraction is fed through line 35 into heat exchange zone $E_3$.

Without departing from the scope of the invention, this fractionation can be achieved at the outlet of heat exchange zone $E_3$.

The fractions f1, f2, f3 of the cooling mixture intended to cool the first stage are obtained for example according to the pattern as follows:

The cooling mixture M' used to obtain the cooling required during the first cooling step is fed into the first heat exchange zone $E_1$ at a temperature of about 40° C. for example and at a pressure for example close to 3 MPa. After leaving this first heat exchange zone $E_1$, it is fed at least partly through line 25 into the second heat exchange zone $E_2$ while another part or first fraction f1 is diverted through line 23, expanded through an expansion valve $V_3$ prior to being fed back into the first heat exchange zone $E_1$ through line 24. The non-diverted fraction of mixture M' is fed into the second heat exchange zone $E_2$ through line 25 and it leaves this heat exchange zone through line 61. A second fraction f2 of the mixture M' is diverted through line 33, expanded by valve $V_1$ and fed back through line 34 into heat exchange zone $E_2$ at a temperature of the order of −30° C. to effect the cooling required in this second heat exchange zone $E_2$.

The non-diverted third fraction f3 is fed into the third heat exchange zone $E_3$, leaves this exchange zone Through line 64 and is expanded through expansion valve $V_2$ prior to being re-injected at the level of the third heat exchange zone $E_3$ in order to effect the cooling of the natural gas and of the cooling mixture M.

After passing through the third heat exchange zone $E_3$ and heat exchange with the natural gas and the cooling mixture, the cooling mixture M' is recompressed in compression stage $K_3$, fed into and mixed with the fraction of the mixture that has been used for cooling the second heat exchange zone from which it flows out through line 26. This mixture is fed through line 66 into a compression stage $K_4$, after which it is mixed with the fraction of the mixture coming from heat exchange zone $E_1$ through line 28, the mixture being then fed through line 27 into compression stage $K_5$. The mixture of the three fractions of recompressed cooling mixture f1, f2 and f3 is fed through line 29 into condenser $C_5$.

Other arrangements can be selected for the first cooling stage without departing from the scope of the invention.

In particular, after the compression step, the cooling mixture M' may be condensed only partly, by water or air cooling, a first liquid fraction being then obtained, and the condensation of mixture M' can be completed within the first stage, in a first heat exchange zone of the first stage where cooling is effected by vaporization of the first liquid fraction, and the second liquid fraction thus obtained may be used to effect cooling in a second heat exchange zone of the first stage.

It is also possible, during the step of compression of the cooling mixture M', to obtain liquid fractions of different compositions by partial condensation at different pressure levels and to use them in order to effect cooling in various heat exchange zones of the first stage.

The operating conditions for the pattern illustrated by the diagram of FIG. 5 are clarified by the following numerical example:

The natural gas flows into line 1 at a rate of 310 t/year. Its composition in mole fractions is as follows:

$C_1$: 0.89

$N_2$: 000

$C_2$: 0.07

$C_3$: 0.015

$C_4$: 0.01

$C_{5+}$: 0.015.

It is at a pressure of 6 MPa and at a temperature of +40° C.

In the first stage comprising exchange zones $E_1$, $E_2$ and $E_3$, it is cooled to a temperature of −70° C.

The cooling mixture used in the first cooling cycle has the following composition (in mole fractions):

$C_1$: 0.001

$C_2$: 0.762

$C_3$: 0.108

$nC_4$: 0.129.

This cooling mixture is compressed in the compression stages $K_3$, $K_4$ and $K_5$ to a pressure of 4 MPa. After leaving compression stage $K_5$, it is cooled in condenser $C_5$ by cooling water until a temperature of 40° C. is reached. It comes out of it totally condensed. In exchange zone $E_1$, it is supercooled to a temperature of 9° C., then expanded through valve $V_3$ and vaporized in exchange zone E1 in order to effect the cooling required in this exchange zone. Its pressure at the inlet of compression stage $K_5$ is 2 MPa. It is thereafter supercooled to a temperature of −29° C. in exchange zone $E_2$, then expanded through valve $V_1$ and vaporized in exchange zone $E_2$ in order to effect the cooling required in this exchange zone. Its pressure at the inlet of compression stage $K_4$ is 0.75 MPa. It is finally supercooled to a temperature of −70° C. in exchange zone $E_3$, then expanded through valve $V_2$ and vaporized in exchange zone $E_3$ in order to effect the cooling required in this exchange zone. Its pressure at the inlet of compression stage $K_3$ is 0.16 MPa.

At the outlet of exchange zone $E_2$, the natural gas is fractionated. After the fractionation step, the natural gas has the composition as follows (in mole fractions):

$C_1$: 0.93

$N_2$: 0.00

$C_2$: 0.07

$C_3$: 0.00

$C_4$: 0.00

$C_{5+}$: 0.00.

In exchange zone $E_3$, it is cooled to −70° C., then it is fed into exchange zone $E_4$ where it is cooled to a temperature of −111° C. then into exchange zone $E_5$ where it is cooled to a temperature of −157° C.

The cooling mixture used in the second cooling cycle and which is in the "condensed single-phase" state at the end of the first cooling step has the composition as follows (in mole fractions):

$N_2$: 0.015

$C_1$: 0.813

$C_2$: 0.172.

This cooling mixture is compressed in compression stages $K_1$ and $K_2$ to a pressure of 5 MPa. After leaving compression stage $K_2$, it is cooled in exchanger $C_2$ by cooling water to a temperature of 40° C. It is thereafter fed into the first cooling stage which it leaves as a supercooled liquid. In exchange zone $E_4$, it is supercooled to a temperature of −111° C., then expanded through valve $V_4$ and vaporized in exchange zone $E_4$ to effect the cooling required in this exchange zone. Its pressure at the inlet of compression stage $K_2$ is 1.3 MPa. It is then supercooled to a temperature of −157° C. in exchange zone $E_5$, then expanded through valve $V_5$ and vaporized in exchange zone $E_5$ to effect the cooling required in this exchange zone.

The natural gas leaves exchange zone $E_5$ at a temperature of −157° C. It is then expanded through expansion valve $V_6$ to a pressure close to the atmospheric pressure, the liquid phase thus obtained forming the LNG produced.

Figure 6:
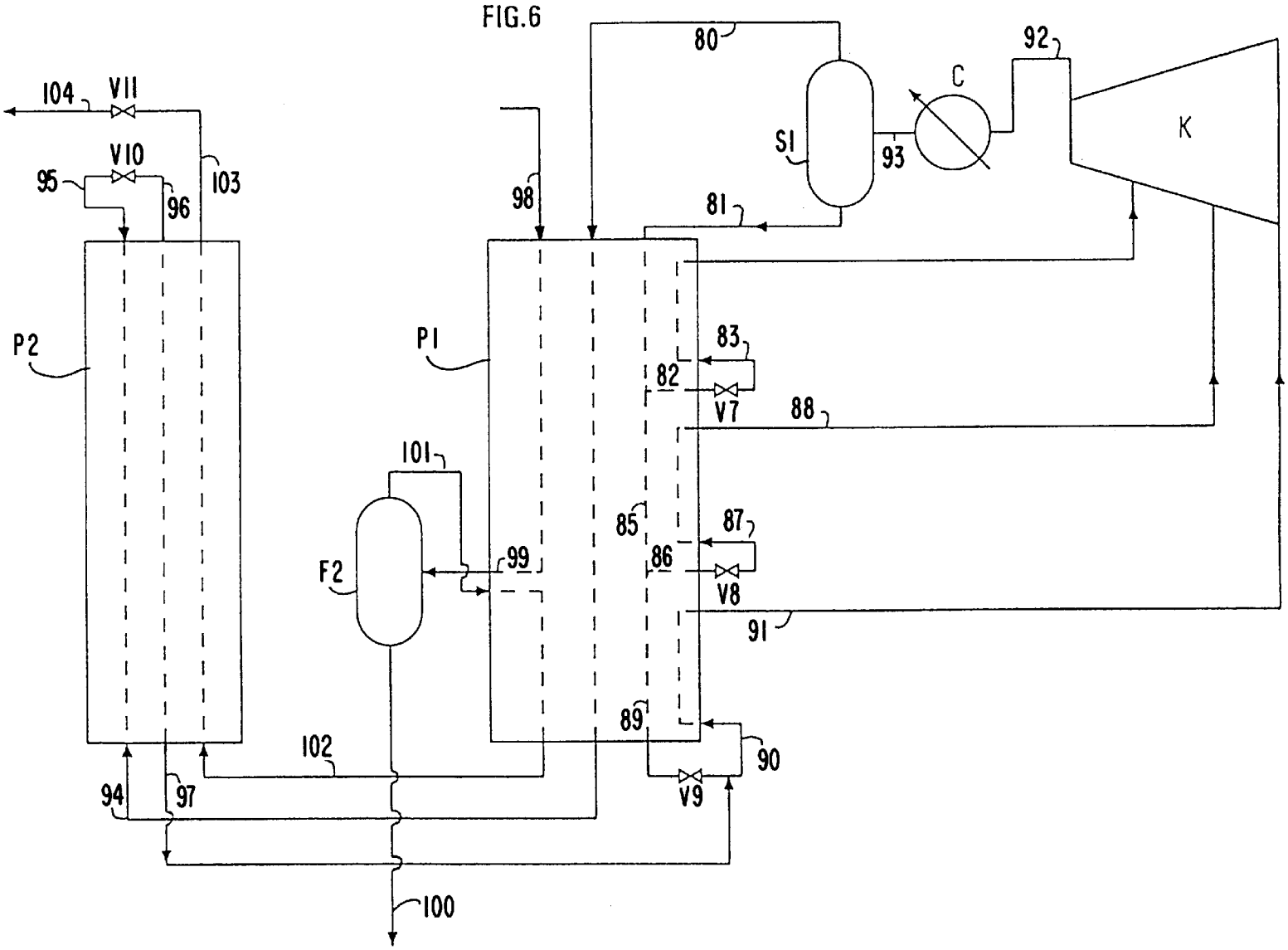

According to another method of operation, the cooling cycles of the first and of the second step are performed by using a single cooling mixture, by operating for example according to the pattern described in FIG. 6.

The single cooling mixture is in this case partly condensed by heat exchange with cooling water or air, the liquid fraction resulting from this partial condensation being supercooled, expanded and vaporized to effect at least partly the cooling required during this first step and the vapor fraction resulting from this partial condensation forming at least partly the mixture M that is, at the end of the first step a) of the process, in the condensed single-phase state.

In the embodiment example described in connection with FIG. 6, the first cooling stage $P_1$ at the outlet of which the cooling mixture is in the "condensed single-phase" state is made up of a single heat exchange line consisting for example of a plate exchanger suited to perform at least the operations described from a device described in FIG. 5 for the first stage, and further comprising draw-off and re-injection means necessary for the natural gas fractionating operation.

In this implementation example of the process, in order to achieve fractionation of the natural gas, the latter is for example drawn off at an intermediate point of exchange line $P_1$, but this can also be achieved at the outlet of exchange line $P_1$ without departing from the scope of the invention.

The second cooling step is carried out in a second stage $P_2$ where the natural gas is supercooled to a temperature sufficiently low, for example −160° C., to obtain it after expansion by a valve $V_{11}$ in the liquid form or LNG under the conditions required for its transportation or storage.

Cooling during these two steps is provided by a single cooling mixture as follows for example:

The single cooling mixture Mr is partly condensed in condenser C, for example by heat exchange with cooling water and/or air, then fed into a separation device $S_1$ after which the liquid fraction and the vapor fraction are processed differently. At least part of the liquid fraction M1 effects the cooling at the level of the first stage and the vapor fraction Mv is condensed in this first stage, in order to obtain the condensed single-phase mixture providing cooling in the second stage.

Thus, the vapor Mv and liquid M1 fractions resulting from the separation of the cooling mixture Mr in drum $S_1$ are discharged respectively at the top of drum $S_1$ through line 80 and at the bottom of the drum, for example through line 81.

The liquid fraction M1 effects, in the first stage, the cooling of the natural gas and it simultaneously allows to obtain, at the outlet of the first stage $P_1$, a "condensed single-phase" cooling mixture from at least part of the vapor fraction Mv of the cooling mixture coming from separating drum $S_1$ and fed into stage $P_1$ through line 80.

To that effect, the liquid fraction M1 fed through line 81 into exchange line $P_1$ is subdivided at a fist temperature level, for example substantially equal to the temperature level of the first heat exchange zone in the example given in connection with FIG. 5, into a first fraction f5 discharged through line 82, expanded and vaporized through expansion valve $V_7$ and fed back to the level of stage $P_1$ through line 83 to effect the cooling of the natural gas circulating in a descending flow for example in the first stage $P_1$, and the cooling of the vapor fraction Mv of the cooling mixture from separating drum $S_1$. The first fraction f5 leaves stage $P_1$ after heat exchange with the natural gas and the vapor fraction of the cooling mixture through line 84 and is fed into a compression stage K (that can comprise one or more compressors).

The non-diverted part of the liquid cooling mixture M1 continues to flow through $P_1$ through line 85 prior to being subdivided again. Thus, a new liquid fraction of mixture M1 is diverted through line 86, expanded and vaporized through valve $V_8$ situated on this line, and re-introduced through line 87 into the first stage $P_1$ to effect the cooling of the natural gas and of the cooling mixture, to a temperature for example close to the temperature obtained at the outlet of the second exchanger $E_2$ in the example described in connection with FIG. 5.

The last non-diverted part of the cooling mixture M1 used as a cooling agent continues to circulate in $P_1$ through line 89, it is thereafter totally discharged from the first stage $P_1$ towards an expansion valve $V_9$ prior to being fed after expansion and vaporization through line 90 into stage $P_1$ where it effects the cooling of the natural gas to a temperature preferably below −40° C. and it allows to condense the vapor fraction Mv of the cooling mixture. The various fractions of the cooling mixture M1 vaporized at the outlet of stage $P_1$ are then fed into compression device K through lines 84, 88 and 91.

The mixtures or the various fractions recompressed in compression device K are thereafter fed through line 92 into condenser C and into separating drum $S_1$ through line 93.

At the end of the first step, i.e. at the outlet of the first stage $P_1$, the part of the cooling mixture initially fed in the vapor form Mv is for example under temperature and pressure conditions substantially close to those given for the example described in connection with FIG. 5, for example −70° C. and 6 MPa. This mixture, that is for example in the liquid or mainly liquid state, is fed into the second stage $P_2$ to effect the second step of the cooling of the natural gas precooled in the first stage $P_1$.

The cooling mixture in the condensed single-phase form is fed through line 94 into the second cooling stage through which it can be cooled and expanded, for example in several steps, according to a pattern described in FIG. 5, or supercooled and expanded in a single step through an expansion valve $V_{10}$ situated on discharge line 95 prior to being re-introduced through line 96 into the second stage for the final cooling of the natural gas, in order to bring it to the desired temperature, for example about −160° C. The supercooled natural gas is then expanded through valve $V_{11}$ in order to obtain the liquefied natural gas or LNG.

The cooling mixture used in the second stage $P_2$ flows out at least partly vaporized after heat exchange with the natural gas through a line 97 prior to being fed back through line 90.

The natural gas introduced at the level of the first stage through line 98, at a temperature of the order of 40° C. for example, is diverted for example towards fractionating device $F_2$ through line 99 at a temperature level for example substantially close to −30° C. At the outlet of fractionating device $F_2$, the part containing heavy hydrocarbons or condensates is discharged through line 100, while the part rich in light hydrocarbons is fed through line 101 into the first stage $P_1$. The part rich in light hydrocarbons continues to be cooled in the first stage to a temperature preferably below −40° C. At the outlet of the first stage, it is led through line 102 into the second cooling stage which it leaves at a temperature for example close to −160° C. prior to being expanded through expansion valve $V_{11}$ or any other device fulfilling the same purpose in order to obtain the liquefied natural gas or LNG thereafter discharged through line 104.

As it is the case with two independent cycles, other arrangements can be selected for the first cooling stage without departing from the scope of the invention.

In particular, it is possible, during the step of compression of the cooling mixture M2, to obtain liquid fractions of different compositions by partial condensation at various pressure levels and to use them for cooling in various heat exchange zones of the first stage.

A common characteristic of the various arrangements described is that the cooling mixture M that is used in the second stage is mainly fed in the vapour phase into the first stage and directly leaves the first stage in the condensed single-phase state, its composition remaining globally unchanged between the inlet of the first stage and the outlet of the first stage, then between the inlet of the second stage and the outlet of the second stage.

Fractionation of the natural gas can be achieved at another point without departing from the scope of the invention.

Advantageously, the process according to the invention allows to perform simultaneously the operation of liquefaction of a fluid consisting at least partly of a mixture of hydrocarbons or natural gas and the selective fractionation of one or more of its constituents.

An embodiment example of such a process is described in FIG. 7, which shows a liquefaction device according to the invention comprising a first and a second cooling stage, respectively $P_3$ and $P_4$, and independent cooling cycles for these two stages. The cooling cycle of the first stage is for example similar to the cycle described in FIG. 5.

The process is for example applied to a natural gas containing other hydrocarbons than methane and notably $C_{3+}$ hydrocarbons.

In this embodiment example, the natural gas to be liquefied and whose fractionation is to be achieved simultaneously is for example fed into the first stage $P_3$ consisting for example of a plate heat exchanger through line 110 situated at the level of the lower part thereof.

The natural gas circulates in an ascending flow within this exchanger in a main circuit allowing matter transfer between the gas to be liquefied and to be fractionated and the condensed hydrocarbon or hydrocarbons that circulate in a descending counter current flow.

The natural gas is thus simultaneously cooled in this first stage and stripped at least partly from the heavy hydrocarbons as a result of the matter exchange.

Cooling of the natural gas is achieved either by using an independent top cycle similar to that described in connection with FIG. 5, or by means of the liquid fraction of a single cooling mixture, according to an arrangement similar to that described in connection with FIG. 6.

The cooled natural gas fraction at least partly stripped from heavy hydrocarbons is discharged through line 111 situated at the level of the upper part of stage $P_3$, at a temperature preferably below −40° C., prior to being fed into the second cooling stage $P_4$, which can comprise for example two heat exchange zones $E_9$, $E_{10}$ arranged in a cascade pattern. The final cooling of this natural gas fraction rich in methane and depleted in propane, butane and heavy hydrocarbons is carried out according to an arrangement for example similar to that described in connection with FIG. 5, for example, in order to obtain at the outlet of the second stage the supercooled natural gas under pressure at a temperature for example close to −160° C., the supercooled natural gas under pressure being expanded through valve $V_{13}$ situated on discharge line 112 producing the liquefied natural gas.

The condensed hydrocarbon liquid phase or phases flowing down through the exchanger by gravity in a counter current flow in relation to the processed gas are discharged through line 113 situated in the lower part of the first stage $P_3$.

The cooling mixture performing the cooling of the natural gas in the second stage is cooled in the first stage at a pressure sufficiently high and at a temperature sufficiently low to allow this cooling mixture to be in the "condensed single-phase" form at the outlet of the first cooling stage. It is then fed through line 114 into the second stage where it cools the natural gas stripped from the heavy hydrocarbons according to an arrangement similar to that used in the example in connection with FIG. 5. After heat exchange with the natural gas, the cooling mixture is fed through line 115 into a compression and cooling device represented by references $K_1$ and $C_9$, $C_{10}$ prior to being re-introduced into the first stage through line 116.

According to another embodiment of the process according to the invention, the condensed single-phase cooling mixture is obtained for example according to the process described in connection with FIG. 6, by condensation of at least part of the vapor fraction of a single cooling mixture.

Various technologies known to the man skilled in the art can be used to achieve the heat exchanges or the heat exchange zones described in the previous examples, and the associated means or devices, some of which are described by way of non limitative examples in the claimant's previous application FR-95/12,002.

Notably, the exchangers $E_1$, $E_2$ . . . described in the previous figures and $P_1$, $P_2$, $P_3$ can be of the shell-and-tube type.

According to another technology, the exchanger is for example a brazed aluminium plate exchanger, comprising for example interposed corrugated plates allowing to hold up the assembly mechanically and simultaneously to improve the heat transfer. The plates delimit channels in which the fluids taking part in the heat exchange during the process circulate. Furthermore, they also serve as a stacked packing that favours contact between the ascending gas and the descending liquid fractions.

The plates are for example made of brazed aluminium or of stainless steel, or of any other material resistant to the fluids to be liquefied and to the cooling mixture.

In order to minimize the cost of the liquefaction device, it is of advantage to use for the first stage one or more brazed aluminium plate exchangers and, for the second stage that undergoes the strongest mechanical and thermal stresses, one or more stainless steel plate exchangers.

It is claimed:

1. Process for liquefying a fluid G including a mixture of hydrocarbons comprising the steps of:

a) cooling said fluid G using a cooling mixture M under pressure and temperature conditions selected to obtain, at the end of step a), a condensed single-phase cooling mixture with substantially no vapor phase, wherein the temperature at the end of step a) is below −40° C., b) supercooling, expanding and vaporizing said condensed single-phase cooling mixture M from step a) and using said cooling mixture to supercool at least part of said fluid G and to supercool part of said cooling mixture, and c) expanding said fluid G supercooled in step b) to obtain a liquid phase at low pressure, and wherein the cooling mixture obtained in step a) is expanded to at least two different pressure levels in said process.

2. A liquefaction process as claimed in claim 1, wherein said cooling mixture M vaporized during step b) is compressed and recycled to step a).

3. A process as claimed in claim 1, wherein at the end of step a), the condensed single-phase cooling mixture is in the liquid phase.

4. A process as claimed in claim 1, wherein at the end of step a), the cooling mixture is in the dense phase.

5. A process as claimed in claim 1, wherein at the end of step a), the temperature is below −60° C.

6. A process as claimed in claim 1, wherein during step a), the cooling mixture is cooled at a pressure at least equal to 3 MPa.

7. A process as in claim 1, wherein the cooling mixture M used in the second step b) comprises at least one or more of a constituent selected from the group consisting of methane, ethane, propane and nitrogen.

8. A process as claimed in claim 1, wherein independent cooling cycles are used for the first step a) and for the second step b).

9. A process as claimed in claim 1, wherein a single cooling cycle is used for the first and the second step, said cycle operating with a cooling mixture partly condensed by heat exchange with cooling water and/or air, the liquid fraction resulting from this partial condensation being supercooled, expanded and vaporized to conduct at least partly the cooling required during this first step and the vapor fraction resulting from this partial condensation forming at least partly mixture M which is a condensed single-phase mixture at the end of the first step a).

10. A process as claimed in claim 1, wherein said fluid G is circulated in an ascending flow and it is fractionated during step a) by matter exchange between said fluid G and at least a condensed liquid fraction circulating in a descending flow.

11. A process as claimed in claim 1, wherein at least one of the cooling steps of step a) and/or of step b) is carried out in a plate exchanger or in a brazed aluminium plate exchanger or in a stainless steel plate exchanger.

12. A device for liquefying a fluid G including a mixture of hydrocarbons, comprising at least a first cooling zone $D_1$ suited to operate under temperature conditions up to at least −40° C., in order to obtain at the outlet a condensed single-phase cooling mixture and to cool said fluid G to at least −40° C., said first cooling zone communicating with at least a second cooling zone $D_2$ suited to operate up to a temperature at least below −160° C., after which fluid G is cooled to a temperature substantially close to −160° C. by vaporization of said cooling mixture coming from said first cooling zone $D_1$, and at least one means for expanding said cooled fluid G from said second cooling zone $D_2$.

13. A device as claimed in claim 12, suited to liquefy and to fractionate a fluid G such as a natural gas, wherein at least one of said cooling zones ($D_1$, $D_2$) comprises at least one means for fractionating said fluid G and allowing to obtain a gas phase enriched in light hydrocarbons and a liquid phase enriched in heavy hydrocarbons.

14. A device as claimed in claim 12, wherein said cooling zones ($D_1$, $D_2$) comprise one or more heat exchangers arranged in a cascade pattern.

15. A device as claimed in claim 14, wherein said heat exchanger or exchangers are brazed aluminium plate exchangers and/or stainless steel plate exchangers.

16. A process as claimed in claim 1, wherein the fluid G including a mixture of hydrocarbons is a natural gas.

17. Process for liquefying a fluid G including a mixture of hydrocarbons comprising at least two steps of:

(a) cooling said fluid G using a cooling mixture, said pressure and temperature conditions being chosen to obtain at the end of step (a) a condensed single-phase cooling mixture, the temperature at the end of said first step being below −40° C., (b) separating said condensed single phase cooling mixture into at least a first and second fraction, wherein said first fraction is expanded at a first level pressure and then vaporized, so as to cool at least the fluid cooled in step (a) and the second fraction not expanded to the first level pressure, and wherein said second fraction is expanded at a second level pressure, so as to cool the fluid G and obtain a supercooled fluid G, and (c) expanding said supercooled fluid G to obtain liquefied fluid G.

18. The process of claim 16 wherein after expanding and vaporizing, said first and second fraction of cooling mixtures are compressed and recycled to step a).

19. A device for liquefying a fluid G including a mixture of hydrocarbons, consisting essentially of, at least a first cooling zone $D_1$ suited to operate under temperature conditions up to at least −40° C., in order to obtain at the outlet a condensed single-phase cooling mixture and to cool said fluid G to at least −40° C., said first cooling zone communicating with at least a second cooling zone $D_2$ suited to operate up to a temperature at least below −160° C., after which fluid G is cooled to a temperature substantially close to −160° C. by vaporization of said cooling mixture coming from said first cooling zone $D_1$, and at least one means for expanding said cooled fluid G from said second cooling zone $D_2$.

20. The device of claim 12, wherein said device comprises means for expanding said single phase cooling mixture to at least two different pressure levels.

21. A device for liquefying a fluid G including a mixture of hydrocarbons comprising the steps of:

a) means for cooling said fluid G using a cooling mixture M under pressure and temperature conditions selected to obtain, at the end of step a), a condensed single-phase cooling mixture with substantially no vapor phase, wherein the temperature at the end of step a) is below −40° C., b) means for supercooling, expanding and vaporizing said condensed single-phase cooling mixture M from step a) and using said cooling mixture to supercool at least part of said fluid G and to supercool part of said cooling mixture, and c) means for expanding said fluid G supercooled in step b) to obtain a liquid phase at low pressure, and wherein the cooling mixture obtained in step a) is expanded to at least two different pressure levels in said process.

* * * * *